US006994629B2

(12) United States Patent
Bussink

(10) Patent No.: US 6,994,629 B2
(45) Date of Patent: Feb. 7, 2006

(54) ATTRACTION

(75) Inventor: Ronald Alexander Bussink, Meistersrute (CH)

(73) Assignee: Ronald Bussink Amusement Design GmbH, Dusseldorf (DE)

( * ) Notice: Subject to any disclaimer, the term of this patent is extended or adjusted under 35 U.S.C. 154(b) by 0 days.

(21) Appl. No.: 10/803,052

(22) Filed: Mar. 18, 2004

(65) Prior Publication Data

US 2005/0113178 A1 May 26, 2005

(30) Foreign Application Priority Data

Mar. 18, 2003 (NL) ..... 1022960

(51) Int. Cl.
*A63G 27/06* (2006.01)

(52) U.S. Cl. ..... 472/44

(58) Field of Classification Search ..... 472/44, 472/45, 27, 28; 104/74–76
See application file for complete search history.

(56) References Cited

U.S. PATENT DOCUMENTS 3,596,905 A 8/1971 Brown
3,610,614 A 10/1971 Nishizawa
5,272,984 A * 12/1993 Bolliger et al. ..... 104/63
5,556,340 A * 9/1996 Bohn et al. ..... 472/59
5,660,076 A * 8/1997 Jonkka et al. ..... 74/399
6,402,624 B1 * 6/2002 Larson et al. ..... 472/44

FOREIGN PATENT DOCUMENTS

| | | |
|---|---|---|
| GB | 22781 | 10/1910 |
| GB | 21137 | 9/1911 |
| JP | 07 075690 | 3/1995 |
| JP | 2000-176179 | 6/2000 |
| JP | 2002-143569 | 5/2002 |
| JP | 2002-159758 | 6/2002 |
| JP | 2002-273063 | 9/2002 |

* cited by examiner

*Primary Examiner*—Kien Nguyen
(74) *Attorney, Agent, or Firm*—Young & Thompson

(57) ABSTRACT

Attraction consisting of a number of gondolas arranged a fixed distance apart which move along a fixed endless track, such as a circle. By this means a difference in height of at least approximately 30 meters is travelled. The gondolas are linked to one another in such a way that the distance between them remains constant and are guided along a track by means of a roller construction. Driving takes place with the aid of a drive cable and with the aid of a supporting platform that can turn with respect to the gondolas it is ensured that the users are always in the same position.

6 Claims, 3 Drawing Sheets

ATTRACTION

The present invention relates to an attraction according to the preamble of claim 1.

An attraction of this type is known by the name "Ferris wheel". Such a wheel can have a height of more than 100 m. Such a Ferris wheel is particularly attractive. The wheel turns continuously at relatively low speed so that it is possible for users to get on and off the gondolas in the bottom section whilst the wheel is turning. The wheel is provided with a central shaft that bears on sheer legs on either side. High forces act on such a shaft. In the case of a wheel that is, for example, 130 m high the weight of the rotating part is, for example, 1500 tonnes. Consequently, the life of the bearing in the shaft is limited and critical. The various authorities have laid down that there must be an evacuation plan for the event that the bearing or the shaft seizes. In such a case further rotation of the wheel is no longer possible. In the case of a wheel that is not so high this does not constitute a problem because in this case the users of the attraction can be removed from the wheel with the aid of a simple (building) crane. However, in the case of a wheel of greater height a crane cannot easily be made available quickly, so that there are serious difficulties in being able to guarantee evacuation under all circumstances should problems arise.

In the British patent specification 22781 (A.D.1910) an attraction is disclosed comprising a frame structure with a stationary track section. Along the frame structure a large number of cross rods extend connected by chains. The chain is motor driven. The cross rods project beyond the track section and on both sides thereof gondolas are suspended. These gondolas are pivotly arranged relative to the cross rods, so that the gondolas are always in a vertical position.

The aim of the invention is to provide an attraction similar to a Ferris wheel with which the problems described above do not exist.

According to the present invention the gondolas no longer move with the rotation of a wheel but the gondolas move along a track or bended track. This track can, for example, be circular, as a result of which the effect of a Ferris wheel is achieved. Compared with the conventional wheel, each of the gondolas has a relatively low weight, so that a relatively simple roller construction, for example consisting of a number of sets of wheels, can suffice. If a construction is built in accordance with the example given above where 1500 tonnes is rotated, it will be possible to reduce the moving weight by a factor of 10 for the same number of gondolas. Because such a construction is not subjected to severe load, a long life and high operational reliability can be expected. If the sets of wheels consist of rolling bearings these are particularly reliable in operation and can be of completely closed construction. Should one of the bearings nevertheless fail, this will then slide along the track. There is no need to fear a risk of the bearing concerned seizing on the track.

The gondola is firmly attached to the track via the roller construction. That is to say, during a circular movement the gondola is, for example, always on the outside or on the inside of the track. This is in contrast to constructions according to the state of the art consisting of two rings located some distance apart between which the gondola is fitted with the aid of a transverse construction, where the gondola is suspended, that is to say with the aid of the suspension construction is always in a different position with respect to the track.

The construction according to the invention is simpler to set up and a relatively lightweight motor can suffice. It must be understood that the attraction described above is a relatively large construction. That is to say, the height is at least 30 meters and preferably 100 m or more.

A floor construction in a gondola that, during rotation, always assumes essentially the same position with respect to the surroundings, for example always remains essentially horizontal, is generally known in the state of the art. Various types of constructions are possible which can be used in the gondola of the attraction according to the present invention. One embodiment comprises self-rotating passenger compartments with horizontal floor by gravity and drive devices.

Movement of the gondolas relative to one another can be prevented with the aid of cables, rods and the like. Driving preferably takes place with the aid of an endless drive cable that is driven by a motor and to which the gondolas are attached.

According to an advantageous embodiment of the invention, all gondolas move continuously, all at the same speed, just as in the case of the Ferris wheel construction described above. A value of, for example, 0.24 m/sec may be mentioned for the speed. At such a speed the users can easily get on and off and the residence time in the gondola is appropriate.

Instead of the circular track described above, it is also possible by means of the present invention to implement other tracks along which the gondolas can be moved. Examples are polygonal polygons, pyramids, ovals and the like.

The invention will be explained in more detail below with reference to an illustrative embodiment shown in the drawing.

Figure 1:
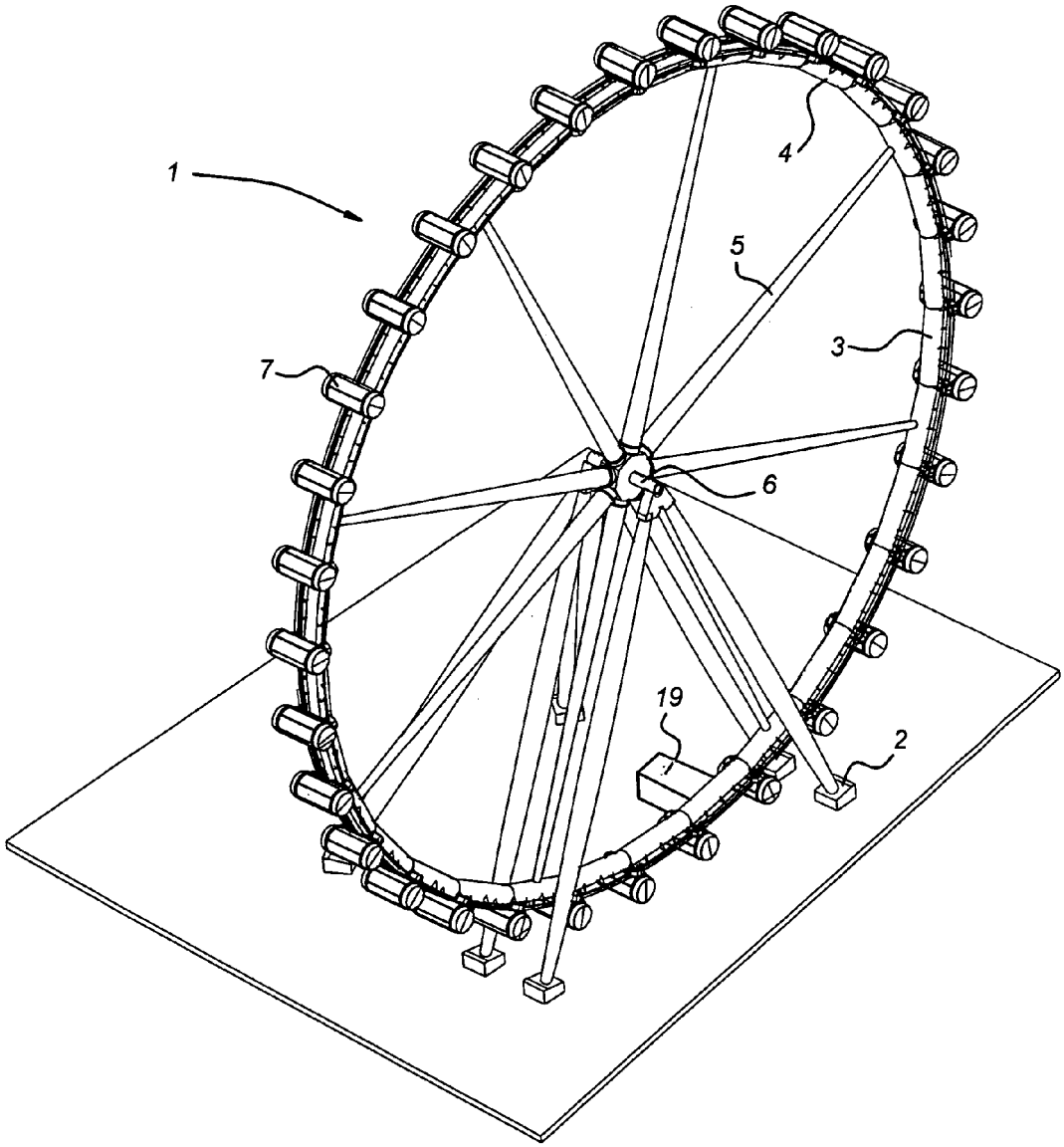
FIG. 1 shows a perspective view of a first embodiment of the attraction according to the invention.

In FIG. 1 the attraction according to the present invention is indicated by 1. This attraction consists of two sheer legs 2 located opposite one another, between which a shaft 6, firmly joined thereto, extends, which shaft 6 is joined to spokes 5 which, in turn, emerge in track sections 4. In contrast to known constructions, this shaft 6 and the spokes 5 are not designed for i.e. displacing a movement. That is to say the track sections 4 are permanently stationary during operation. As a result it is possible to construct the set-up in another way, that is to say without the sheer legs 2 or with spokes of different construction.

The gondolas 7 move along the stationary track sections 4 in accordance with the circular track in FIG. 1.

Figure 2:
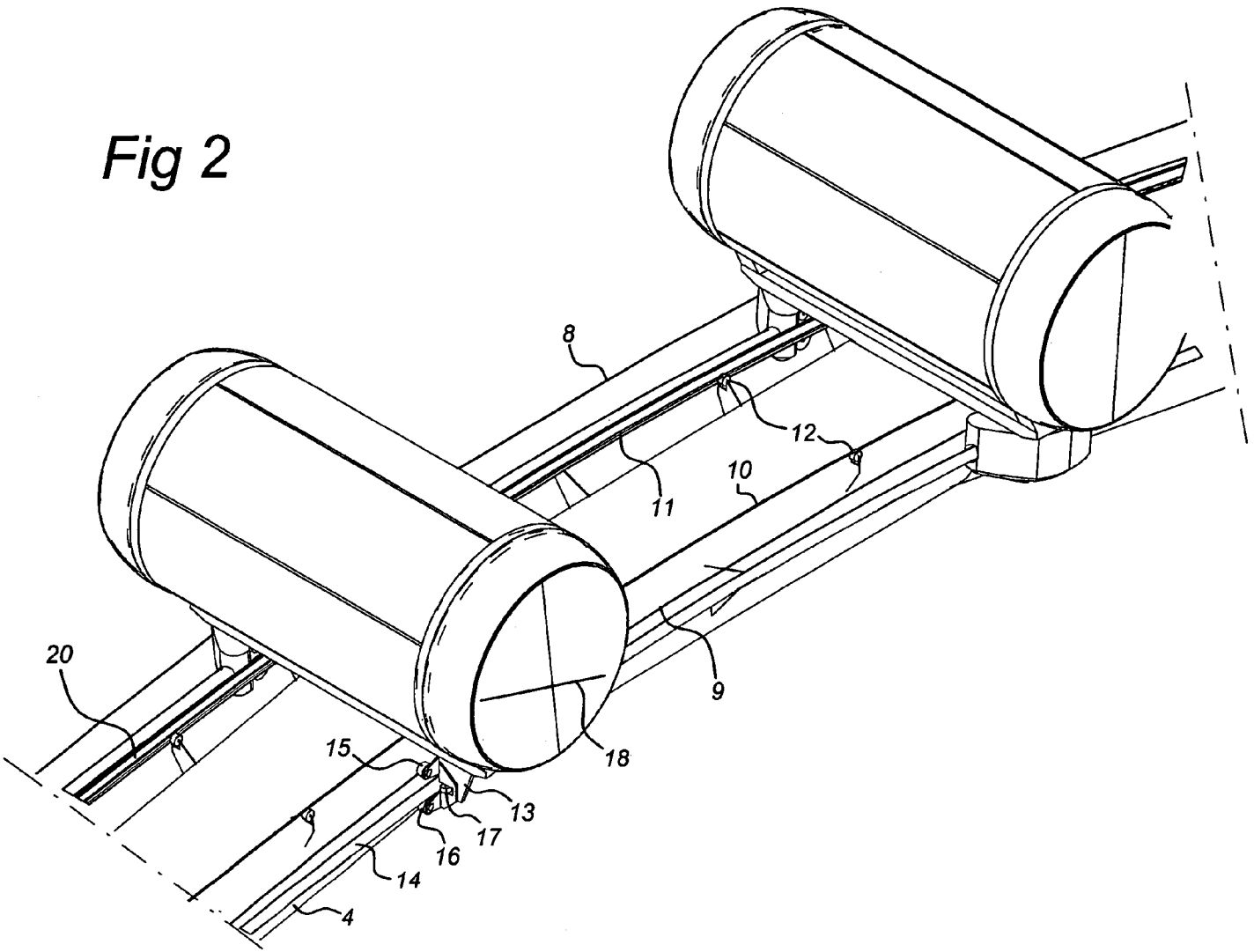
FIG. 2 shows a detail of the installation shown in FIG. 1.

This construction is shown in detail in FIG. 2. The track section 4 is provided on either side with a guide 14 projecting transversely. In each case, three sets of wheels 15, 16, 17 of the gondola 7 concerned engage on said guide 14. The set of wheels 15 serves to support the gondola in the top section of the attraction, whilst the set of wheels 16 serves for confinement in the vertical direction. It will be understood that in the bottom section of the attraction the gondola is, however, suspended on set of wheels 16 and set of wheels 15 serves for confinement. Set of wheels 17 serves for the lateral positioning of the gondola. Each set of wheels consists of a number of self-lubricating rolling bearings (ball bearings). These components are maintenance-free and in the event of failure these are easily able to slide along the knife-edge guide 14. That is to say that even in the event of one bearing seizing it is still possible to move the gondolas in such a way that all passengers can get off safely.

Each gondola is provided with a floor 18 or other construction which delimits the space occupied by the users. This floor 18 is fitted such that it is always horizontal.

The gondolas are linked to one another by connecting cables 8 and 9. These extend all round so that the gondolas are always positioned a fixed distance from one another. Instead of cables it is also possible to use rods or the like. Driving takes place with the aid of drive cables 10 and 11. These drive cables are guided over rollers 12. Driving of the drive cables takes place with the aid of the drive motor 19 indicated diagrammatically in FIG. 1. This drive motor can be fitted at a low point and can be of relatively lightweight construction. Of course, it is possible to use two or more drive motors. There is a live rail 20 and each gondola is provided with power take-off means, which are not shown. Lighting in the gondola and communication with the surroundings is possible by this means. Furthermore, climate control can be provided by this means.

The construction described above has a height of more than 30 meters. Preferably, this construction has a height of more than 100 meters.

Figure 3:
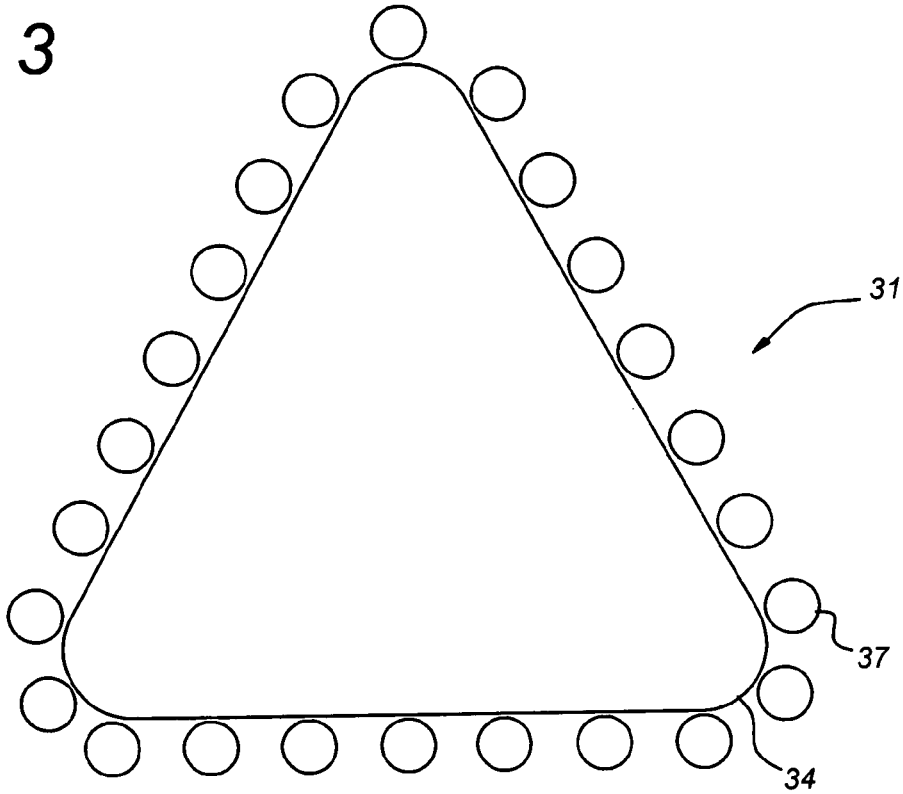
FIG. 3 shows, highly diagrammatically, a second embodiment of the present invention.
Figure 4:
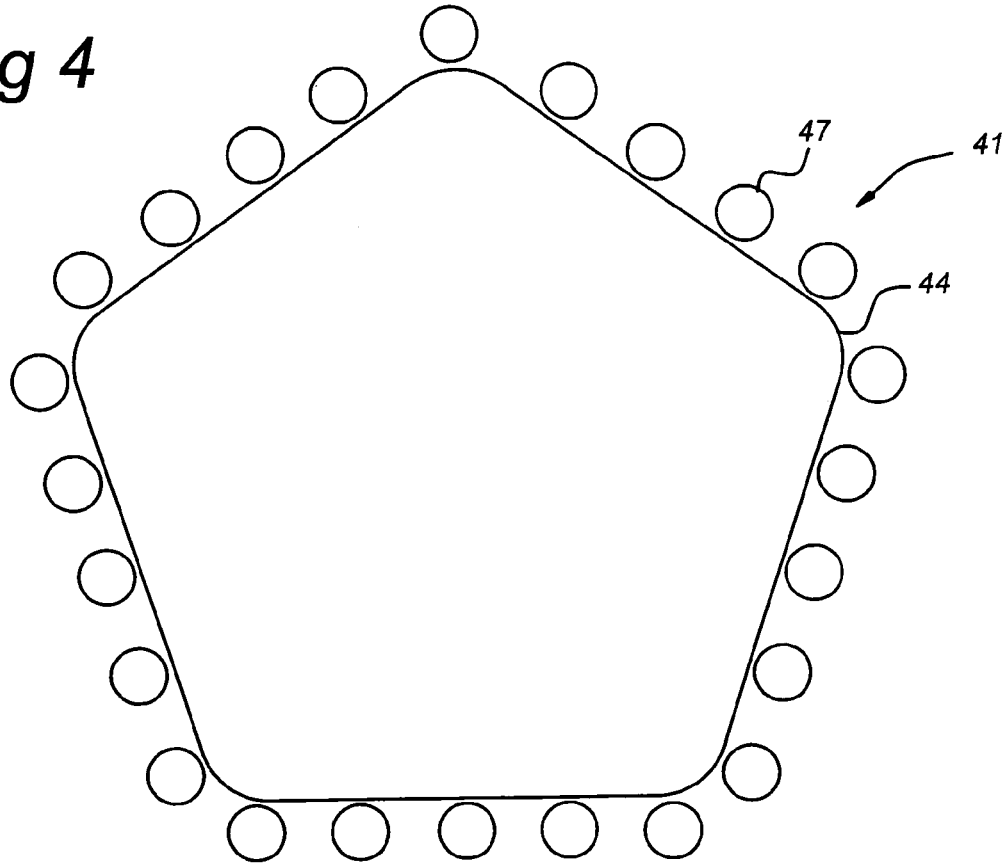
FIG. 4 shows, highly diagrammatically, a third variant of the invention.

A variant of the present invention is shown in FIG. 3. This attraction is indicated in its entirety by 31 and consists of a track 34 along which gondolas 37 move. Coupling and driving of the gondolas take place in the manner shown in FIGS. 1 and 2. Another variant is indicated in its entirety by 41 in FIG. 4. In this figure the track section is shown by 44 and each of the gondolas is indicated by 47.

It will be understood that any other closed track, such as a square, oval or the like, can be implemented with the present invention. A particularly large construction is achieved with the present invention whilst, at, the same time it is possible to comply with all safety regulations with the construction of a relatively lightweight moving section. The support for the track section can be designed depending on the construction. That is to say it is no longer necessary to use a conventional construction with sheer legs as shown in FIG. 1.

Further modifications will be immediately apparent to those skilled in the art and fall within the scope of the appended claims.

What is claimed is:

1. Attraction comprising a number of gondolas arranged a fixed distance apart and arranged such that they are movable in respect of their height relative to a frame construction, the gondolas travelling along an endless track with a minimum height difference of 30 meters, said frame construction has a stationary track section, wherein the gondolas are provided with a roller construction for continuous engagement with said track section and movement along the latter, wherein said gondolas are linked by a drive, driven by a motor, that extends along said track section and engages on at least one of said gondolas, said gondolas being always in a fixed position relative to said stationary track section, wherein each of said gondolas is provided with a supporting platform for the users, which supporting platform is rotatable with respect to said gondola in such a way that the position thereof with respect to the surroundings remains essentially the same, and wherein said drive comprises a drive cable, wherein said motor is in the bottom section of said frame construction.

2. Attraction according to claim 1, wherein said track section comprises two spaced rails for accommodation said gondola therein between.

3. Attraction according to claim 1, wherein said track section is circular.

4. Attraction according to claim 1, wherein said track section is pyramid-shaped.

5. Attraction according to claim 1, wherein said link between said gondolas comprises cables or rods.

6. Attraction according to claim 1, wherein said roller construction comprises sets of wheels.

* * * * *